US011445834B2

(12) United States Patent
Ontiveros et al.

(10) Patent No.: US 11,445,834 B2
(45) Date of Patent: Sep. 20, 2022

(54) BABY TRAM

(71) Applicants: Meagan Reneé Ontiveros, Vallejo, CA (US); Michele Elaine Mayers, Bremerton, WA (US)

(72) Inventors: Meagan Reneé Ontiveros, Vallejo, CA (US); Michele Elaine Mayers, Bremerton, WA (US)

(73) Assignees: Meagan Reneé Ontiveros, Vallejo, CA (US); Michele Elaine Myers, Bremerton, WA (US)

( * ) Notice: Subject to any disclaimer, the term of this patent is extended or adjusted under 35 U.S.C. 154(b) by 49 days.

(21) Appl. No.: 16/596,401

(22) Filed: Oct. 8, 2019

(65) Prior Publication Data

US 2020/0085208 A1 Mar. 19, 2020

Related U.S. Application Data

(63) Continuation of application No. 16/134,791, filed on Sep. 18, 2018, now Pat. No. 10,448,750.

(51) Int. Cl.

| | |
|---|---|
| ***A47D 13/04*** | (2006.01) |
| ***A47D 13/08*** | (2006.01) |
| ***A47D 13/10*** | (2006.01) |

(52) U.S. Cl.

CPC ..... *A47D 13/043* (2013.01); *A47D 13/08* (2013.01); *A47D 13/107* (2013.01)

(58) Field of Classification Search

CPC ..... A44D 13/00; A47D 13/01; A47D 13/043; A47D 13/08; A47D 13/107; A47D 13/105; A63B 22/00; A63B 2022/00

See application file for complete search history.

(56) References Cited

U.S. PATENT DOCUMENTS

| | | | | | |
|---|---|---|---|---|---|
| 642,435 | A * | 1/1900 | Firnhaber | A63G 7/00 | 104/62 |
| 839,681 | A * | 12/1906 | Voigt, Sr. | A47D 3/005 | 297/138 |
| 841,700 | A * | 1/1907 | Linden | A47D 3/005 | 297/138 |
| 1,294,300 | A * | 2/1919 | Noel, Sr. | A63B 22/001 | 297/138 |
| 3,204,954 | A * | 9/1965 | Scannell | A61H 3/008 | 482/69 |
| 3,721,436 | A * | 3/1973 | Barthel, Jr. | A61H 3/008 | 482/69 |

(Continued)

*Primary Examiner* — Garrett K Atkinson

(74) *Attorney, Agent, or Firm* — Perkins Coie LLP

(57) ABSTRACT

Presented here is an apparatus that includes a dual rail structure, an attachment mechanism, a child seat and upright supports. The apparatus can be 5 feet tall, 5 feet wide, and 2 feet deep. The upright supports lift the dual rail structure above the ground. The adjustable elastic cords can be connected to and suspended from the dual rail structure using wheels, which can traverse the dual rail structure. The child can be placed so that the child can walk, swing, and/or jump. The seat can rotate 360° with respect to the dual rail structure, enabling the child to change direction of motion within the dual rail structure. The entire apparatus can be collapsed using joints, which enable the bars of the apparatus to fold and/or disconnect for compact packing and easy transport.

17 Claims, 15 Drawing Sheets

(56) References Cited

U.S. PATENT DOCUMENTS 3,721,437 A * 3/1973 Skaricic ..... A61H 3/008 248/566
3,780,663 A * 12/1973 Pettit ..... A61G 7/1015 104/307
3,796,430 A * 3/1974 Sudo ..... A47D 13/043 108/115
4,252,063 A * 2/1981 Brooks, Jr. ..... A61H 3/008 104/307
4,340,216 A * 7/1982 Murphy ..... A61H 3/008 105/150
4,356,902 A * 11/1982 Murphy ..... A61H 3/008 193/35 R
4,493,120 A * 1/1985 Watts ..... A47D 13/063 256/25
4,795,151 A * 1/1989 Mulcaster ..... A47D 13/04 482/68
4,911,426 A * 3/1990 Scales ..... A61H 3/008 128/845
4,948,120 A * 8/1990 Krueger ..... A47D 13/105 297/274
5,050,504 A * 9/1991 Mulcaster ..... A47D 13/04 104/242
5,366,231 A * 11/1994 Hung ..... A47C 7/006 16/44
5,458,550 A * 10/1995 Braim ..... A47D 13/04 297/274
5,522,782 A * 6/1996 Kurtin ..... A47D 13/04 280/87.051
5,601,434 A * 2/1997 Winters ..... A63B 69/0064 434/253
5,626,540 A * 5/1997 Hall ..... A61H 1/0229 482/69
5,667,461 A * 9/1997 Hall ..... A61H 1/0229 472/15
5,743,836 A * 4/1998 Lo ..... A47D 13/043 280/87.051
5,819,772 A * 10/1998 Pi ..... A61H 3/04 135/66
6,001,047 A * 12/1999 Ferrara ..... A47D 13/043 280/87.051
6,080,087 A * 6/2000 Bingham ..... A47D 13/046 482/69
6,192,535 B1 * 2/2001 Warner, Jr. ..... A47D 5/006 135/96
6,244,991 B1 * 6/2001 Bingham ..... A47D 13/046 482/69
7,462,138 B2 * 12/2008 Shetty ..... A61H 3/008 482/51
8,382,005 B1 * 2/2013 Fletcher ..... A63G 7/00 104/53
8,474,071 B2 * 7/2013 Tricault ..... A47D 9/005 5/97
8,943,622 B2 * 2/2015 Saint ..... A47D 5/00 5/93.1
9,107,513 B2 * 8/2015 Asfa ..... A47D 13/043
9,204,733 B2 * 12/2015 Welch ..... A47D 13/107
9,510,991 B2 * 12/2016 Stockmaster ..... A61H 3/008
9,616,274 B2 * 4/2017 Wehrell ..... A61H 1/0229
9,924,807 B1 * 3/2018 Richter ..... A47D 13/043
10,028,593 B1 * 7/2018 Mathews, Jr. ..... A47D 13/046
2004/0063550 A1 * 4/2004 Harris ..... A61H 3/008 482/69
2004/0074414 A1 * 4/2004 Phillips ..... A61G 7/1015 104/93
2005/0183759 A1 * 8/2005 Wolfe ..... A61H 3/04 135/67
2007/0004567 A1 * 1/2007 Shetty ..... A61H 3/008 482/69
2008/0012409 A1 * 1/2008 Chen ..... A47D 13/107 297/274
2009/0062082 A1 * 3/2009 Spencer-Kramer .... A47D 13/04 482/66
2011/0018216 A1 * 1/2011 Cheng ..... A47D 13/04 280/87.051
2012/0311782 A1 * 12/2012 Tricault ..... A47D 7/002 5/99.1
2013/0116604 A1 * 5/2013 Morilla ..... A61G 7/1015 601/33
2013/0130866 A1 * 5/2013 Wehrell ..... A61H 1/0229 482/5
2014/0206503 A1 * 7/2014 Stockmaster ..... A61H 3/008 482/4
2015/0108731 A1 * 4/2015 Asfa ..... A47D 13/043 280/87.051
2015/0366741 A1 * 12/2015 Ropes ..... A47D 13/04 482/69
2017/0087392 A1 * 3/2017 Lambert ..... A61H 3/008
2017/0135893 A1 * 5/2017 Stockmaster ..... A61H 3/008

* cited by examiner

BABY TRAM

CROSS-REFERENCE TO RELATED APPLICATIONS

This application is a continuation of U.S. patent application Ser. No. 16/134,791, entitled "RAIL MOUNTED SEAT," filed Sep. 18, 2018, which is incorporated by reference herein in its entirety.

TECHNICAL FIELD

The present application is related to a rail mounted seat, and more specifically, to a rail mounted seat that provides a safe environment for a baby to walk, jump and swing.

BACKGROUND

Young children are delicate little beings that require the utmost care in order to protect and keep them safe from harm. As a result, there are a myriad of product intended to provide protection from the dangers generated by a variety of sources. A few examples include car seats, sunshades, and highchairs. While there seem to be products intended to protect infants from a seemingly endless list of dangers, one learning experience they are not protected from is when they are learning to walk bounds or exercise the leg muscles. Child walkers have been used in the past but have been proven to be inherently dangerous, especially when used around stairways. Accordingly, there exists a need for a system to safely control children but provide them the freedom necessary when learning how to walk and explore their surroundings.

SUMMARY

Presented here is an apparatus that includes a dual rail structure, an attachment mechanism, a child seat and upright supports. The apparatus can be 5 feet tall, 5 feet wide, and 2 feet deep. The upright supports lift the dual rail structure above the ground. The adjustable elastic cords can be connected to and suspended from the dual rail structure using wheels, which can traverse the dual rail structure. The child can be placed so that the child can walk, swing, and/or jump. The seat can rotate 360° with respect to the dual rail structure, enabling the child to change direction of motion within the dual rail structure. The entire apparatus can be collapsed using joints, which enable the bars of the apparatus to fold and/or disconnect for compact packing and easy transport. The use of the rail mounted seat allows parents and care providers of toddlers who are just beginning to walk and explore their world the stability to do so for long periods of time while ensuring the safety, comfort and entertainment of the child.

DETAILED DESCRIPTION

Rail Mounted Seat

Presented here is an apparatus that includes a dual rail structure, an attachment mechanism, a child seat and upright supports. The apparatus can be 5 feet tall, 5 feet wide, and 2 feet deep. The upright supports lift the dual rail structure above the ground. The adjustable elastic cords can be connected to and suspended from the dual rail structure using wheels, which can traverse the dual rail structure. The child can be placed so that the child can walk, swing, and/or jump. The seat can rotate 360° with respect to the dual rail structure, enabling the child to change direction of motion within the dual rail structure. The entire apparatus can be collapsed using joints, which enable the bars of the apparatus to fold and/or disconnect for compact packing and easy transport. The use of the rail mounted seat allows parents and care providers of toddlers who are just beginning to walk and explore their world the stability to do so for long periods of time while ensuring the safety, comfort and entertainment of the child.

Figure 1:
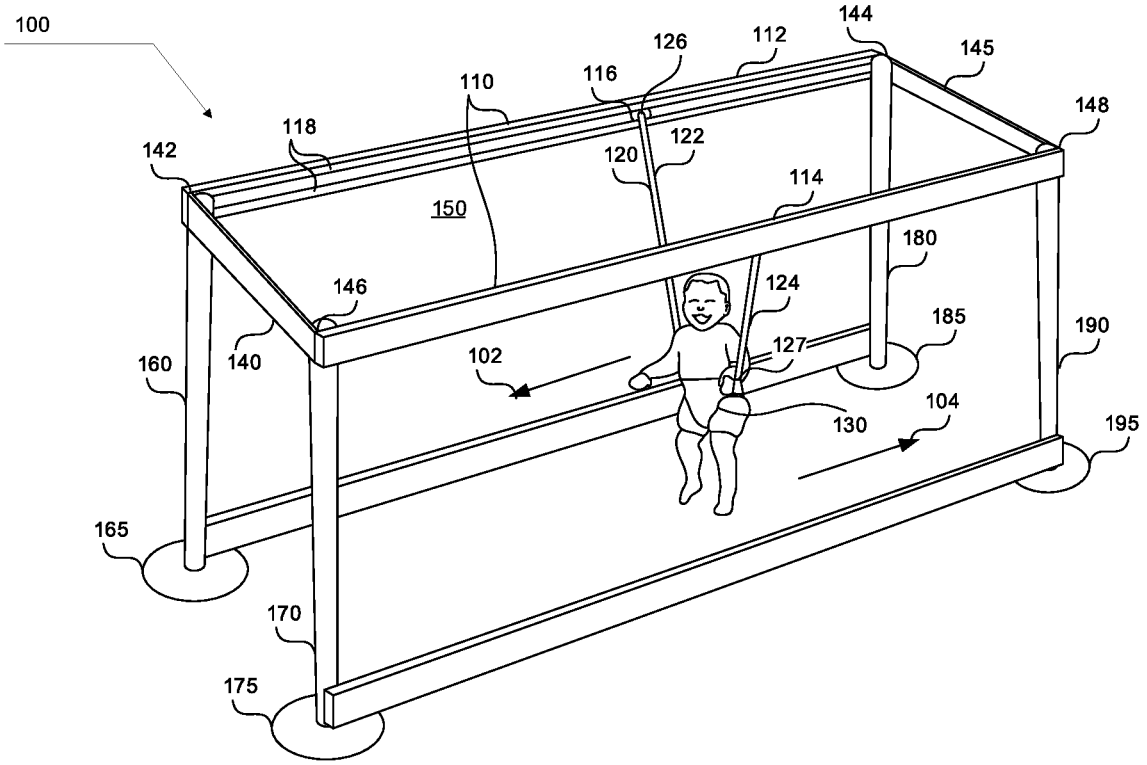
FIG. 1 shows an apparatus to support a child while allowing the child to move, jump and swing.

FIG. 1 shows an apparatus to support a child while allowing the child to move, jump and swing. The apparatus 100, i.e., rail mounted seat, prevents the child from falling while the child moves within an area enclosed by the apparatus 100. The child can be as young as 6 months old, and does not have to be able to walk. The apparatus 100 can also be used as a safe baby walker, teaching a child how to walk, or supporting a toddler while walking, without the risk of the child moving outside of the confines of the apparatus 100 and rolling off the stairs. In some embodiments, the apparatus 100 can be used to seat an adult needing assistance to walk, such as during physical therapy.

The apparatus 100 includes a dual rail structure ("rail structure") 110, an attachment mechanism 120, the seat 130, an optional transverse member 140, 145, the upright supports 160, 170, 180, 190, and the contact members 165, 175, 185, 195. The apparatus 100 can be at least 3 feet tall, 3.5 feet wide and 2 feet deep. In one embodiment, the apparatus 100 can be approximately 5 feet tall, 5 feet wide and 2 feet deep.

The rail structure 110 defines an enclosed area 150 within which the child can move. The rail structure can be secured to the ground using an upright support 160, 170, 180, 190. The rail structure 110 can have a width of at least 40 inches, along which the child can traverse the rail structure 110. The upright supports 160, 170, 180, 190 can be secured to the ground or can be movably resting on the ground as shown in FIG. 1. The contact members 165, 175, 185, 195 resting on the ground can have a wide base for stability. The rail structure 110 can include a first rail 112 and a second rail 114 parallel to the first rail 112.

The attachment mechanism 120 can include a first attachment member 122 and a second attachment member 124. The attachment members 122, 124 can have an adjustable length to accommodate children of various heights. The length of the attachment members 122, 124 can vary between 3 and 5 feet. The attachment members 122, 124 can be made out of elastic material to enable the child to jump while seated in the seat 130. In addition, the attachment mechanism 120 can support the weight of the child so that the child can lift their legs and swing in the seat 130.

The first attachment member 122 can include a first distal end 126 movably secured to the first rail 112, and a first proximal end (not pictured) secured to a first attachment point associated with the seat 130. The second attachment member 124 can include a second distal end (not pictured) movably secured to the second rail 114, and a second proximal end 127 secured to a second attachment point associated with the seat 130. The first attachment point and the second attachment point can be opposite each other as shown in FIG. 1. The attachment mechanism 120 can traverse the enclosed area 150 while carrying the seat 130, thus enabling the child to move around the enclosed area 150.

The distal end 126 can be attached to a wheel 116 (only one pictured), which can slide along the rails 112, 114. The wheel 116 can be secured to the rails 112, 114 using overhangs 118 (only one pictured), which prevent the wheel from detaching from the rails 112, 114. The movement of the wheel enables the motion of the child with respect to the rail structure 110. The distal end 126 can be detachable from the wheel 116 to enable disassembly and compact packing of the apparatus 100.

The seat 130 can support the child in an upright position and can enable the child to move relative to the rail structure 110. The seat 130 can rotate in relation to the rail structure 110 and can enable the child to change a direction of movement so that the child can walk forward in both directions 102, 104 within the apparatus 100.

Figure 6:
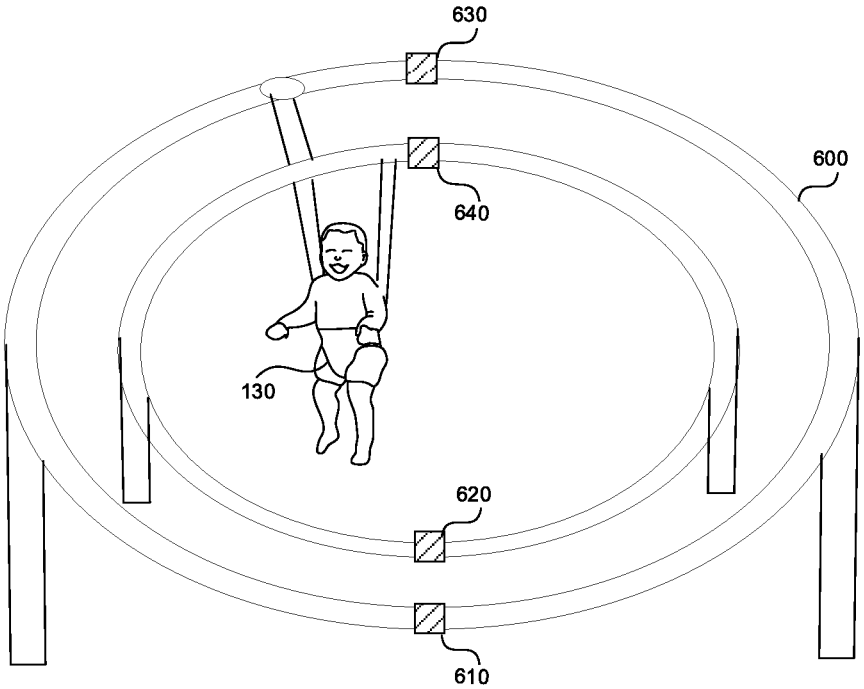
FIG. 6 shows a circular rail structure.

The transverse members 140, 145 can include a first end 142, 144 and a second end 146, 148, respectively. The first end 142, 144 can be detachably secured to the first rail 112 and the second end 146, 148 can be secured to the second rail 114. The transverse members 140, 145 can determine the distance between the two rails 112, 114. The transverse members 140, 145 can be without rails. The transverse members 140, 145 do not have to be present in a closed enclosure as shown in FIG. 6.

Figure 2A:
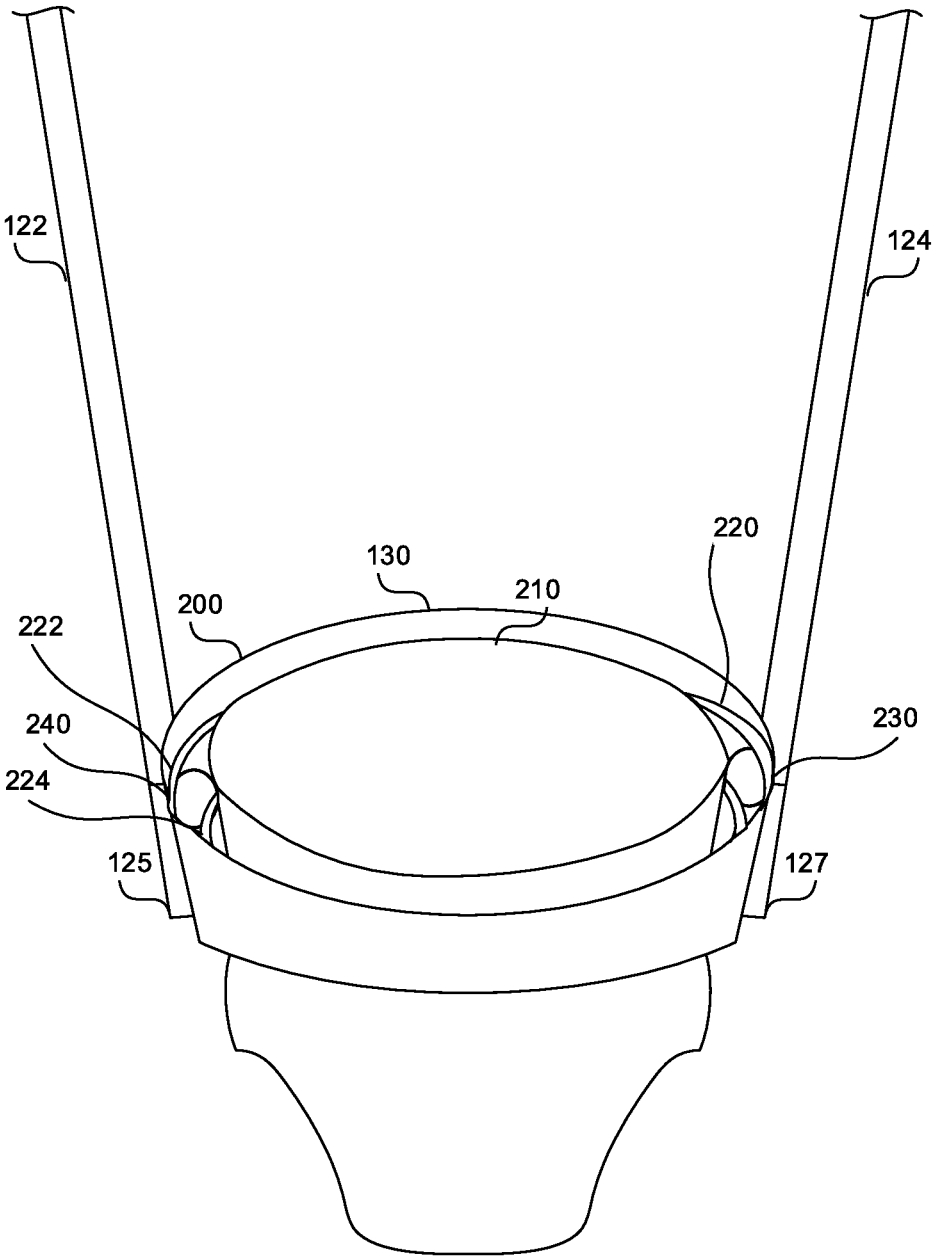
FIGS. 2A-2B show a rotatable seat 130.
Figure 2B:
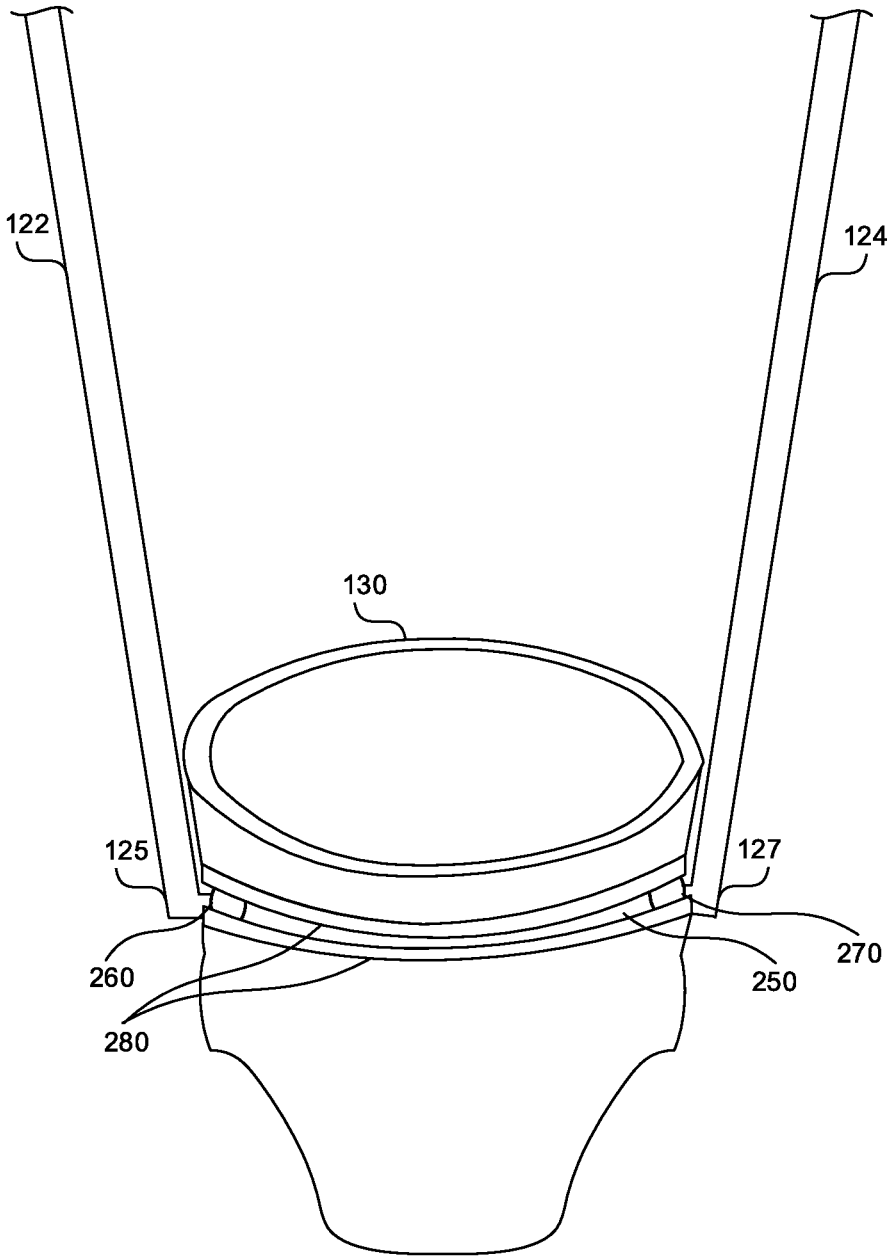

FIGS. 2A-2B show a rotatable seat 130. The seat 130 can be attached to the proximal ends 125, 127 of the attachment members 122, 124, respectively. The seat 130 can rotate 360° with respect to the attachment members 122, 124. The rotation of the seat 130 can enable the child to change direction of movement within the rail structure 110 in FIG. 1.

The seat 130 defines two openings for legs at the bottom of the seat 130, to enable the child placed in the seat to reach the ground with their legs. To enable the rotation, the seat 130 can include a rail 220 in FIG. 2A, 250 in FIG. 2B, and a wheel 230, 240 in FIG. 2A, 260, 270 in FIG. 2B. The rail 220, 250 circumvents a portion of the seat 130.

In FIG. 2A, the seat 130 contains two portions: a stationary member 200 and a rotating member 210. The stationary member 200 is statically attached to the proximal ends 125, 127 of the attachment members 122, 124. The stationary member 200 of the seat 130 can include a rail 220, which circumvents the portion of the seat, i.e., the stationary member 200. The stationary member 200 of the seat 130 can surround the circumference of the rotating member 210. The stationary member 200 can be shaped like a ring. The stationary member 200 does not necessarily have openings for legs.

Wheels 230, 240 attached to the rotating member 210 of the seat 130 can traverse the rail 220. The rail 220 can have an overhang 222, 224 to prevent the wheels 230, 240 from moving off the rail. The movement of the wheels 230, 240 along the rail 220 can enable the rotation of the person seated inside the seat 130.

In another embodiment, the rail 220 can circumvent the rotating member 210, while the wheels 230, 240 are attached to the stationary member 200. The rail 220 can include the overhang 222, 224. The movement of the wheels 230, 240 along the rail 220 can cause the rotating member 210 to rotate with respect to the attachment members 122, 124, and the whole rail structure 110 in FIG. 1.

In FIG. 2B, the seat 130 contains a rail 250. The proximal ends 125, 127 of the attachment members 122, 124 can be secured to wheels 260, 270, respectively. The wheels 260, 270 can traverse the rail 250, thus enabling rotation of the seat 130 with respect to the attachment members 122, 124. The wheels 260, 270 can be opposite each other, and can be confined to the rail using an overhang 280.

Figure 3A:
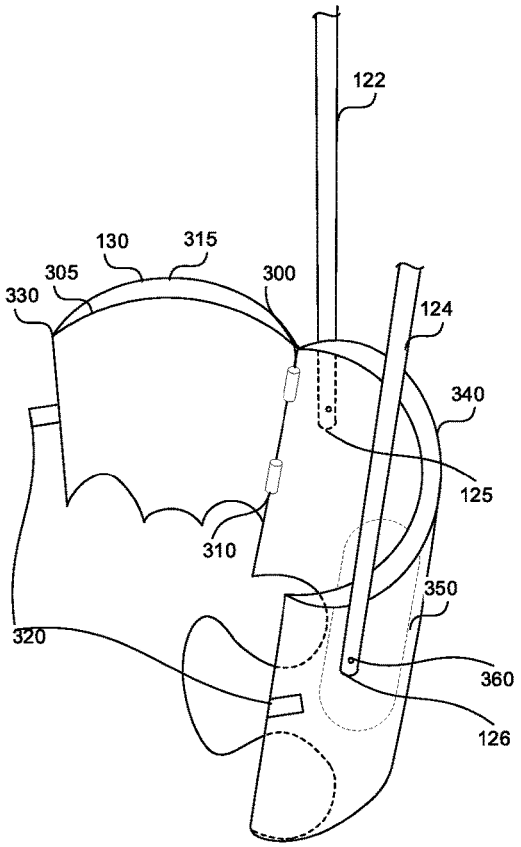
FIGS. 3A-3B show opening of the seat 130.
Figure 3B:
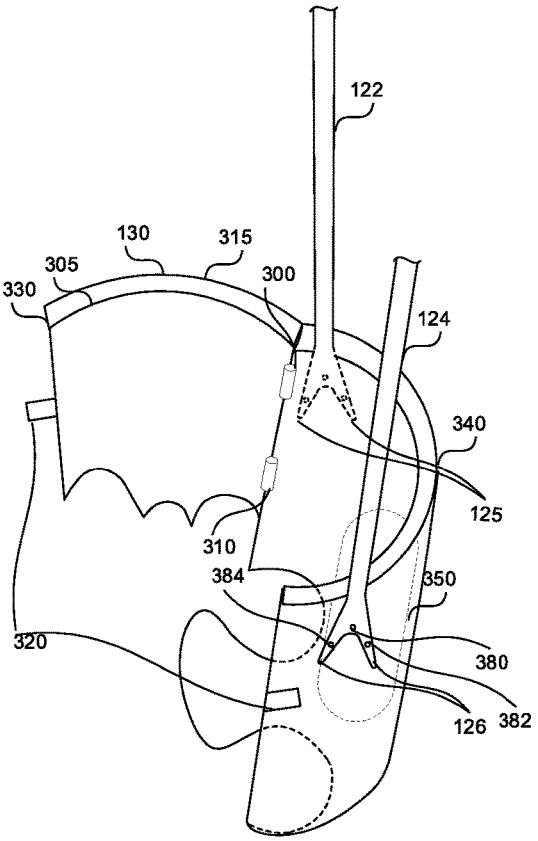

FIGS. 3A-3B show opening of the seat 130. The seat 130 can be opened to allow a caregiver to place a person horizontally inside the seat, instead of having to lift the person and place the person vertically inside the seat 130. The seat 130 can include one or more hinges 300, 310, and a locking mechanism 320. The hinges 300, 310 can be attached to both an inner portion of the seat 305, and an outer portion of the seat 315. The hinges 300, 310 can also be attached to the rail 220 in FIG. 2A, 250 in FIG. 2B.

The locking mechanism 320 can release and allow the front portion of the seat 330 to rotate around the hinges 300, 310. The locking mechanism 320 can be a latch hook, a toggle, a spring lock, etc. The locking mechanism 320 can be attached to the outer portion of the seat 315, or can be inserted between the outer portion of the seat 315 and the inner portion of the seat 305. The back portion of the seat 340 receiving the person can have a weight 350 to prevent the person placed in the back portion of the seat 340 from falling forward.

The proximal ends 125, 127 of the attachment members 122, 124 can be secured to the seat 130 at a single attachment point 360 (only one labeled for brevity) in FIG. 3A, or can be secured at multiple attachment points 380, 382, 384 (only three labeled for brevity) in FIG. 3B. Multiple attachment points 380, 382, 384 reduce the likelihood of the seat rotating forward or backward and releasing the person inside the seat. Multiple attachment points 380, 382, 384 can enable the child to swing back and forth in the seat 130 without the risk of the seat 130 rotating forward or backward. The attachment points 360, 380, 382, 384 can be detachable from the seat 130 for compact packing.

Figure 4:
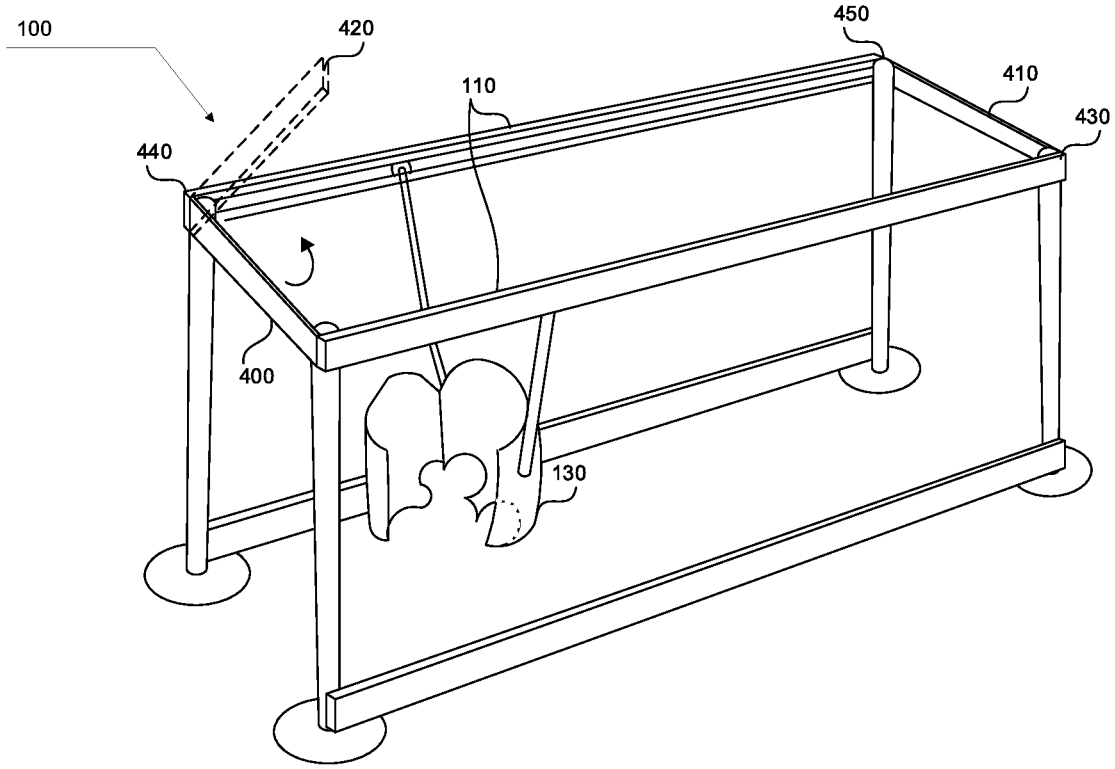
FIG. 4 shows a transverse member unlocking.

FIG. 4 shows a transverse member unlocking. One or more of the transverse members 400, 410 can unlock to allow horizontal placement of the person within the seat 130, without having to lift the person and place them in the seat vertically. The transverse members can have a first end 420, 430, respectively, and a second end 440, 450, respectively. The first end 420, 430 can be detachable and can rotate vertically, as shown in FIG. 4, or horizontally (not pictured) around the second end 440, 450.

In one embodiment, both the first end 420, 430 and the second end 440, 450 can be detachable from the rail structure 110 to enable disassembly and compact packing of the apparatus 100. In another embodiment, the second end can rotate horizontally (not pictured) to fold and be flush with the rail of the rail structure 110 to enable disassembly and compact packing.

Figure 5:
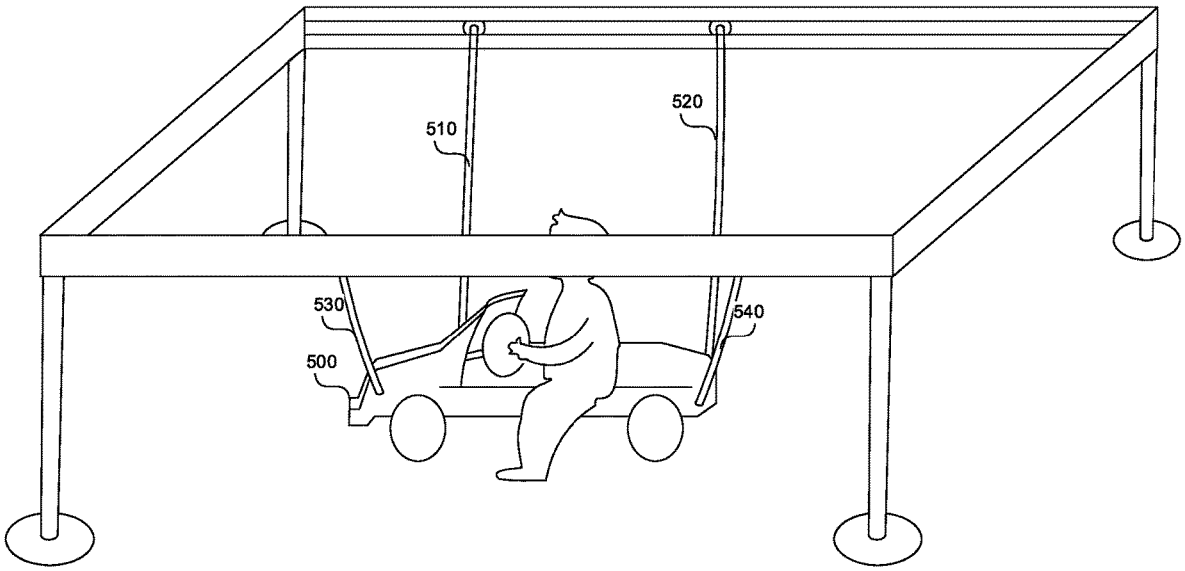
FIG. 5 shows a seat having a different shape.

FIG. 5 shows a seat having a different shape. The seat 500 can take on various shapes. The seat 500 can be in the shape of the seat 130 in FIG. 1, in the shape of a car as shown in FIG. 5, a rocking horse, butterfly, etc. When the seat 500 has an elongated shape, such as a car, the seat 500 can be secured to the rail structure 110 using two or more attachment members 510, 520, 530, 540 on each side of the seat 500. The attachment members 510, 520, 530, 540 can be elastic strings which enable the person to jump up and down while seated in the seat 500.

FIG. 6 shows a circular rail structure. The rail structure 110 in FIG. 1 can take on various shapes such as a closed loop rail structure 600. The rail structure 600 can be circular as shown in FIG. 6, elliptical, sinusoidal, or any other closed shape. When the rail structure 600 is a closed shape, no transverse members are necessary. The rail structure 600 can be detachable at several joints 610, 620, 630, 640 for easy folding. Further, the detachable joints can enable attachment of a different rail structure to create various rail structure shapes, which a person seated in the seat 130 can traverse.

Figure 7:
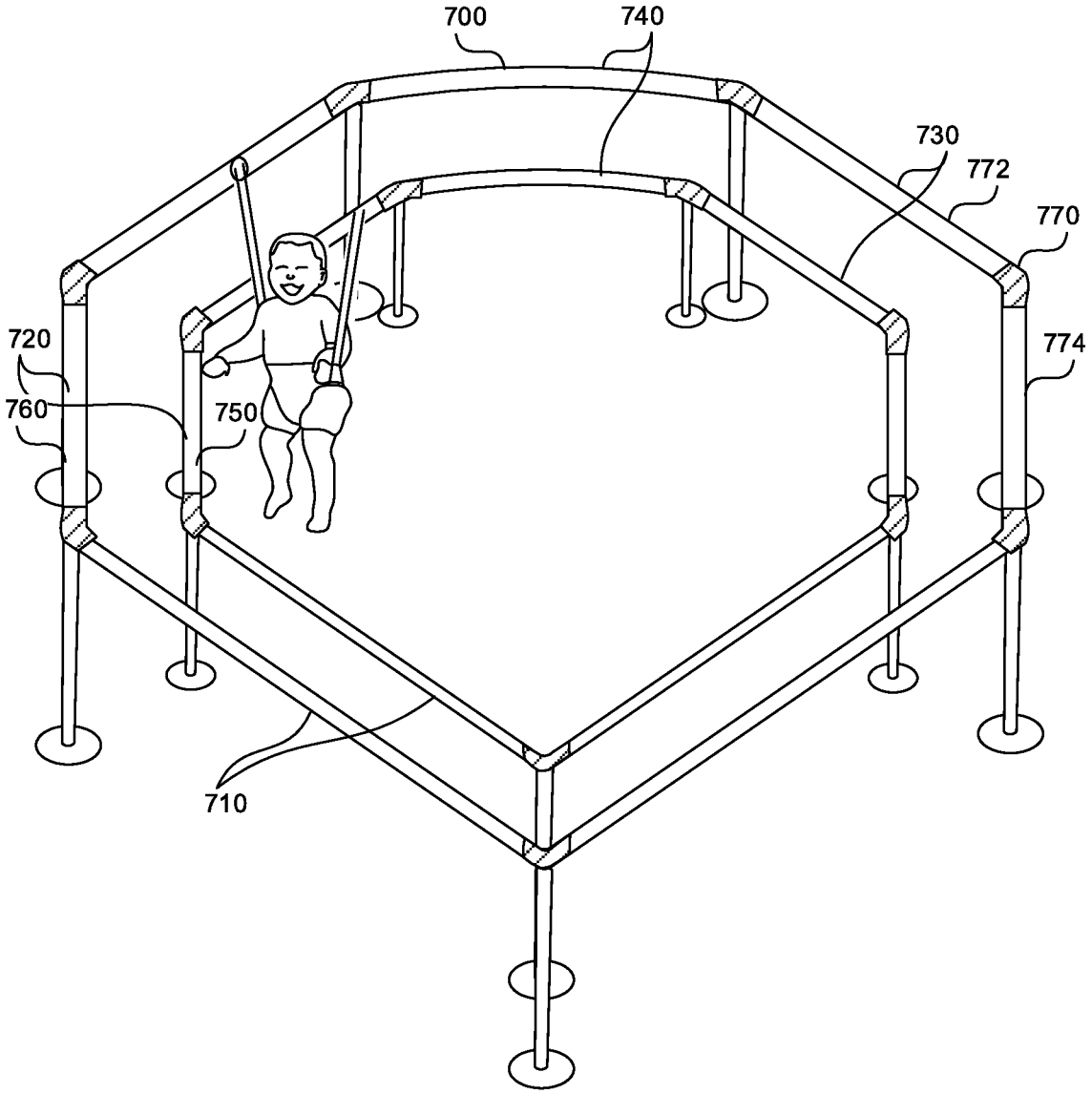
FIG. 7 shows a rail structure assembled from modular rail structures.

FIG. 7 shows a rail structure 700 assembled from modular rail structures 710, 720, 730, 740 (only four labeled for brevity). The modular rail structures 710, 720, 730, 740 can be standalone rail structures as shown in FIGS. 1, 5, 6, with an addition of two transverse members. For example, rail structure 720 with an addition of two transverse members and an extension rail to extend the rail 750 to match the length of rail 760 can become the rail structure 110 in FIG. 1. In another example, the rail structure 740 can form a part of a circular rail structure as shown in FIG. 6.

The modular rail structures 710, 720, 730, 740 can be joined at joints 770 (only one labeled for brevity). The joint 770 can be used to add an extension rail, as described above, and/or to add a transverse member. The joint 770 can be used to disassemble the rail structure 700 into smaller pieces. The joint 770 can also be a folding joint, meaning that it cannot be detached from either of the rails it is connecting, and can be used to fold over the two rails 772, 774 next to each other for compact packing.

Figure 8A:
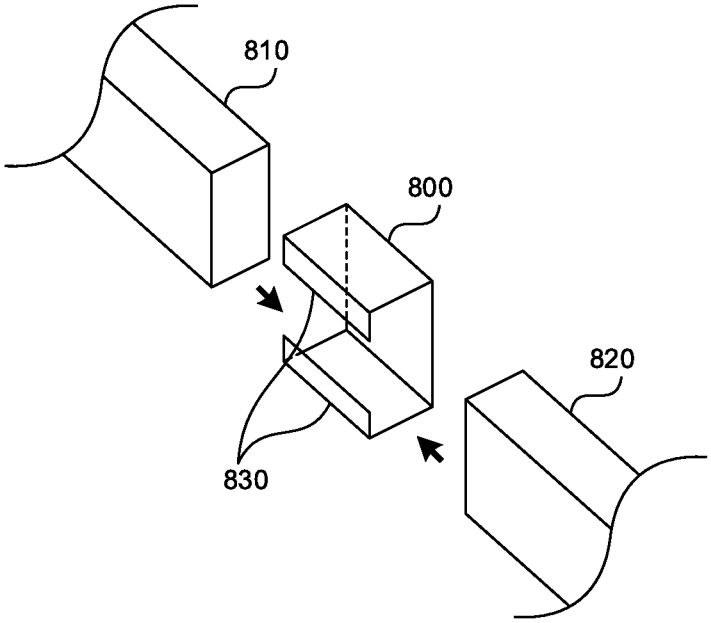
FIG. 8A shows a joint.

FIG. 8A shows a joint. The joint 800 can have at least two open sides through which rails and/or transverse members in 810, 820 can be inserted into the joint 800. The joint 800 can have an overhang 830 preventing the inserted rails and/or transverse members 810, 820 from releasing from the joint 800. In another embodiment, the joint 800 can be a rectangular box with two open sides through which rails and/or transverse members 810, 820 can be inserted.

The joint 800 can be made of flexible material so that the two rails and/or transverse members 810, 820 can be arranged in varying angles to each other. The joint 800 can include a locking hinge to enable the joint 800 to bend and lock at various angles.

Figure 8B:
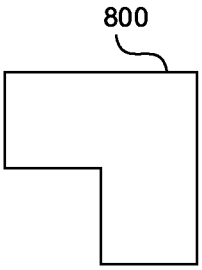
FIGS. 8B-8D show top views of the joint bent in varying angles and/or shapes.
Figure 8C:
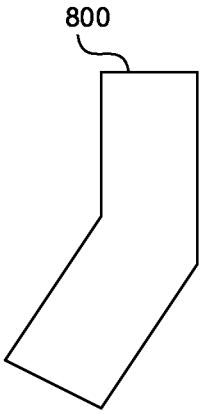
Figure 8D:
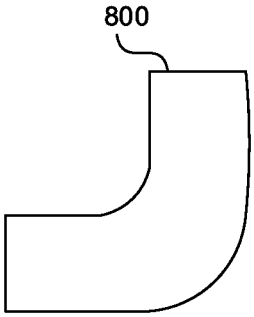

FIGS. 8B-8D show top views of the joint 800 bent in varying angles and/or shapes. In FIG. 8B, the joint 800 can take on a 90° angle. In FIG. 8C, the joint 800 can take on an angle greater than 90°, while in FIG. 8D, the joint 800 can take on a rounded shape.

Figure 9:
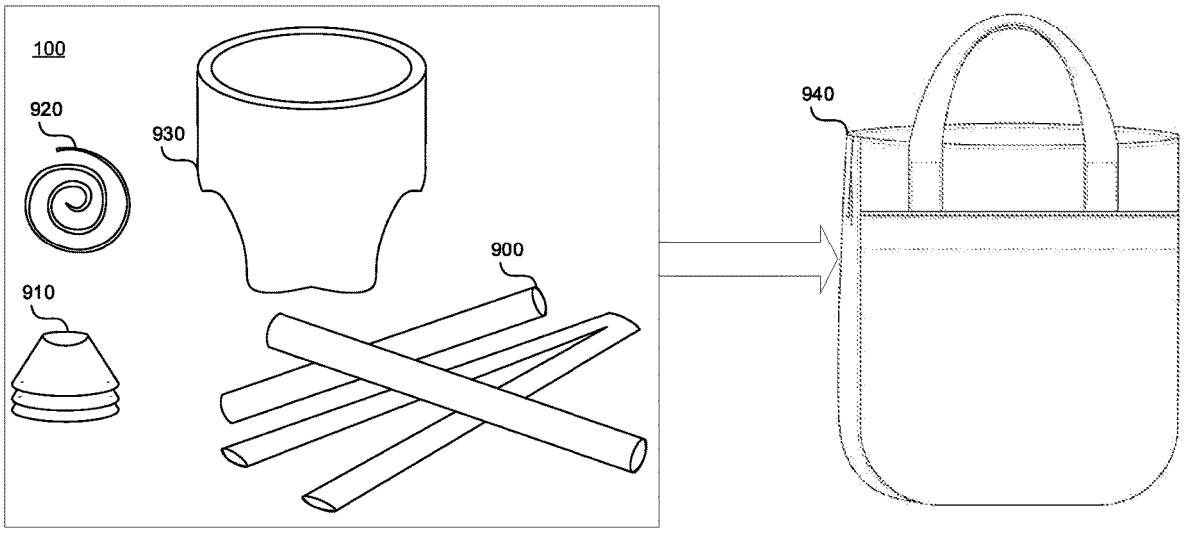
FIG. 9 shows the apparatus in FIG. 1.

FIG. 9 shows the apparatus 100 in FIG. 1 disassembled. The apparatus 100 can be disassembled into rail structure pieces, including disjointed or folded bars 900, and contact members 910, i.e., coasters supporting the rail structure, bungee cords 920, the seat 930, etc. The disassembled apparatus 100 can fit inside a handbag 940 for easy transport.

Figure 10:
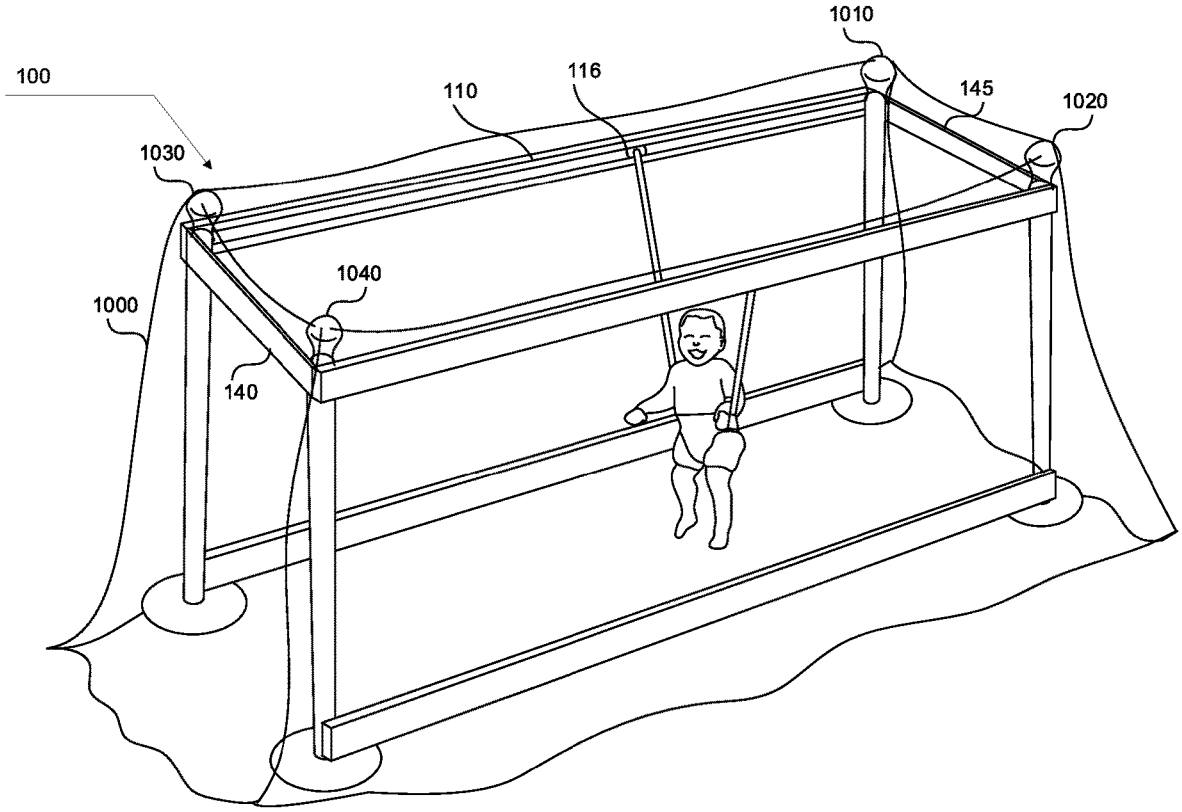
FIG. 10 shows an accessory of the apparatus.

FIG. 10 shows an accessory of the apparatus 100. The apparatus 100 can include additional accessories such as mosquito netting, hanging toys, electronic elements, etc. The mosquito net 1000 can be placed over the top of the rail structure 110 to protect the child from insects. In one embodiment, rounded pegs 1010, 1020, 1030, 1040 can be added to the corners of the rail structure 110 to prevent the mosquito net 1000 from tearing at the contact points with the rail structure 110.

Other accessories can include toys mounted on hooks attached to the rail structure 110 or the transverse members 140, 145. When the toys are mounted on the rail structure 110, the toy hooks are C-shaped and do not obstruct the passage of the wheels 116 (only one pictured) along the rail structure 110. The rail structure 110 can include electronic triggers along the rail so that various electronic elements such as sound and lights are activated as the wheels 116 pass over the electronic triggers.

Figure 11:
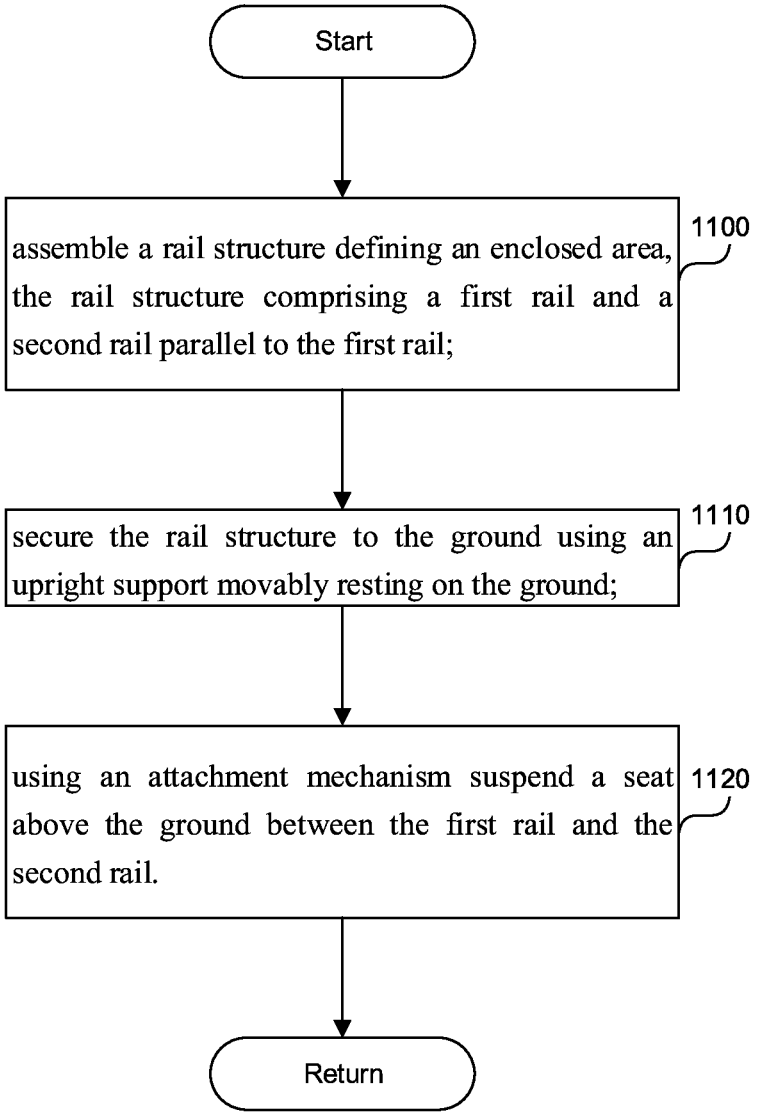
FIG. 11 is a flowchart of a method to assemble the apparatus 100.

FIG. 11 is a flowchart of a method to assemble the apparatus 100. The steps can be performed by a machine assembling the final product. In step 1100, a rail structure defining an enclosed area can be assembled. The rail structure can include a first rail and a second rail parallel to the first rail.

In step 1110, the rail structure can be secured to the ground using an upright support movably resting on the ground. For stability, the upright support can include conically-shaped contact members, i.e., coasters, that rest on the ground.

In step 1120, a distal end of an attachment mechanism can be movably secured to the rail structure. A proximal end of the attachment mechanism can be detachably secured to a seat. The attachment mechanism can suspend the seat above the ground between the first rail and the second rail. The attachment mechanism can traverse the enclosed area while carrying the seat. The seat can receive a person such as a baby or an adult.

The attachment mechanism can have a first attachment member and a second attachment member. The first attachment member can be connected to the first rail and to the first attachment point associated with the seat. The second attachment member can be connected to the second rail and to the second attachment point associated with the seat. The first and second attachment points can be on opposite ends of the seat.

The rails can be extendable so that different rail structures can be connected to each other to create various shapes. The rail structures can be connected using a joining member, as described in FIGS. 8A-8D.

The seat can be opened as described in FIGS. 3A-3B, and the person can be positioned into the seat horizontally, instead of having to lift the person above the seat and place the person vertically into the seat. The seat can have a locking mechanism that can unlock to allow the horizontal placement of the person.

The rail structure can be disassembled into multiple rail pieces at a joint along the rail structure into a plurality of rail pieces. The rail structure can be completely detachable at the joint, or the joint can enable folding of the rail structure. The multiple rail pieces can be compressed into a compact shape for packing.

Figure 12:
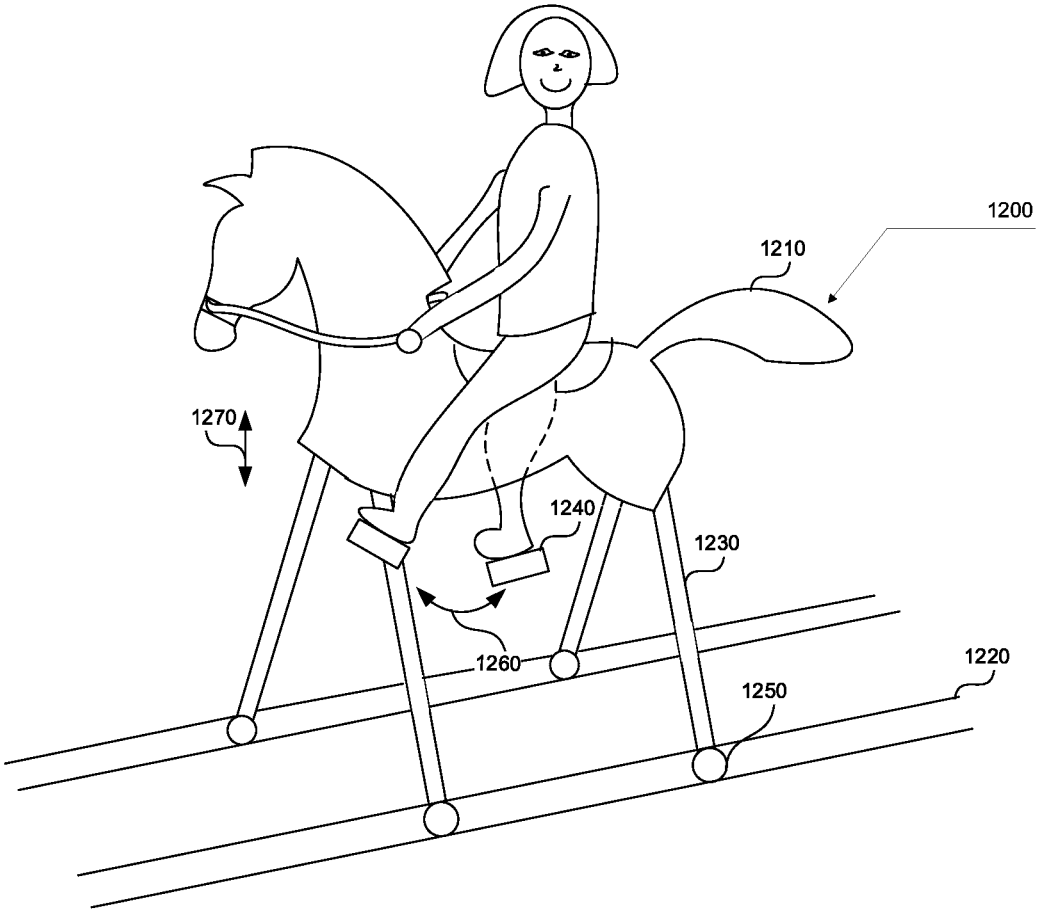
FIG. 12 shows an apparatus to enable a child to ride in a seat along a rail, according to one embodiment.

FIG. 12 shows an apparatus to enable a child to ride in a seat along a rail, according to one embodiment. The apparatus 1200 includes the seat 1210, the rails 1220, the mounting member 1230, and a locomotion member 1240. The seat 1210 can take on various state shapes such as a horse, a bird, a butterfly, a car, a train, etc. The seat 1210 can accommodate a child sitting in the seat. The seat 1210 can optionally include straps to secure the child to the seat. The rails 1220 can be placed on the ground and arranged into a closed shape such as a rectangle, a circle, or any combination of a rectilinear or a curvilinear shape. The mounting member 1230 connects the seat 1210 to the rails 1220, allowing the seat 1210 to move along the rails 1220. The mounting member 1230 can include wheels 1250 (only one labeled for brevity) which can roll along the rail 1220, thus moving the seat 1210 along the rail 1220.

The locomotion member 1240 allows the child to control the movement of the seat 1210 along the rails 1220. The child can move the locomotion member 1240 forwards and backwards in the direction 1260, or up-and-down in the direction 1270. In response to the movement in the direction 1260, 1270, the seat 1210 and the locomotion member 1240 can move forward or backward along the track. In addition, or instead of the motion along the track, in response to the movement in the direction 1260, 1270, the seat 1210 can move up and down, thus giving a sense of vertical movement to the child.

Figure 13:
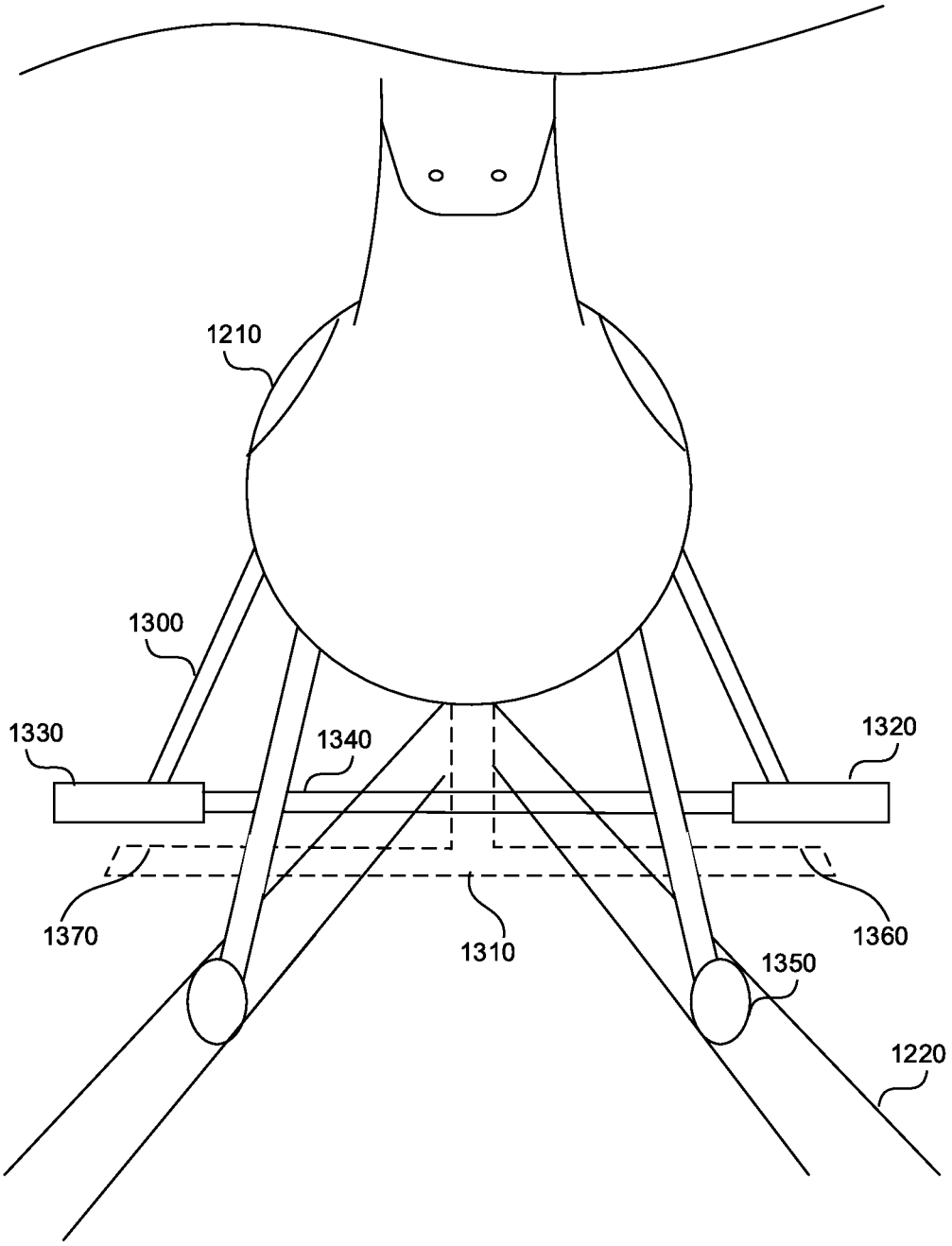
FIG. 13 is a front view of the seat shown in FIG. 12.

FIG. 13 is a front view of the seat shown in FIG. 12. The locomotion member 1240 in FIG. 12 can take on various shapes such as 1300 or 1310. Locomotion member 1300 can support the child's feet on platforms 1320, 1330, which are connected by the bar 1340. The forward and backward motion of the locomotion member 1300 can cause the wheels 1350 (only one labeled for brevity) to move along the rail 1220, and/or can cause upward and our motion of the seat 1210. Locomotion member 1310 can support the child's feet on the platforms 1360, 1370. The child can push the platforms 1360, 1370 down to cause the wheels 1350 to move along the rail 1220, and/or to cause upward and downward motion of the seat 1210.

Figure 14:
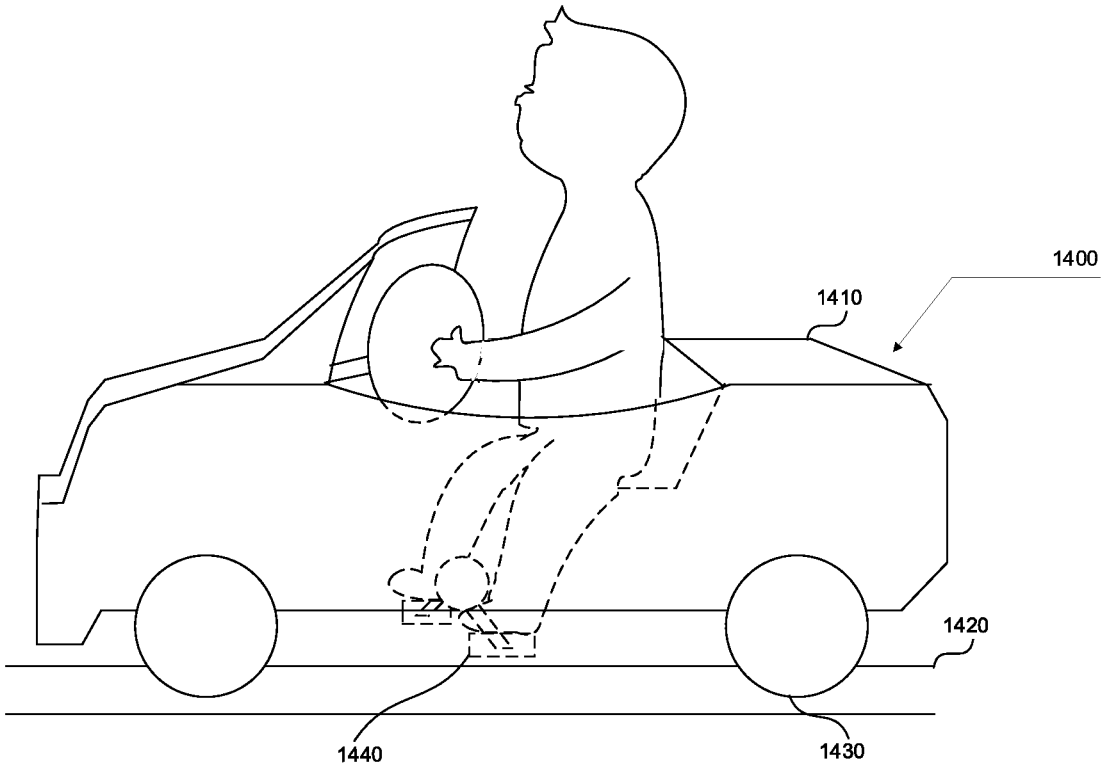
FIG. 14 shows an apparatus to enable a child to ride in a seat along a rail, according to another embodiment.

FIG. 14 shows an apparatus to enable a child to ride in a seat along a rail, according to another embodiment. The apparatus 1400 includes a seat 1410, the rail 1420, a mounting member 1430, and a locomotion member 1440. The seat 1410 can take on various shapes, as mentioned above. The seat 1410 can optionally include straps to secure the child to the seat. The rail 1420 can take on any combination of a rectilinear and/or curvilinear shape. The rail 1420 can be closed, or can be open. The mounting member 1430 can include wheels that can move forward and backward along the rail 1420. The locomotion member 1440 can include pedals which can cause the mounting member to move up and down and/or back-and-forth along the rail 1420.

Remarks

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. A system comprising:

a rail structure defining an enclosed area, the rail structure attached to a movable upright support resting on the ground, the rail structure comprising a first rail, a second rail and a third rail configured to be secured to the first rail and the second rail and to detach from at least the first rail and enable substantially horizontal placement of a person, wherein detaching the third rail and enabling the substantially horizontal placement of the person maintains a first distance between the first rail and the ground, and a second distance between the second rail and the ground; and an attachment mechanism having a distal end and a proximal end, the distal end movably secured to the rail structure, the proximal end secured to a seat and suspending the seat above the ground between the first rail and the second rail, the attachment mechanism to traverse the enclosed area while carrying the seat.

2. The system of claim 1, the seat to rotate in relation to the rail structure thereby enabling a change in a direction of motion.

3. The system of claim 1, the enclosed area defining a partially curvilinear or a rectilinear shape.

4. The system of claim 1, the seat comprising a movable joint configured to open the seat and enable substantially horizontal placement of the person into the seat.

5. The system of claim 1, comprising:

a rail circumventing a closed member of the seat; and a wheel traversing the rail to enable rotation of the seat.

6. The system of claim 1, comprising:

a joining member coupled to the rail structure enabling an addition of a second rail structure to the rail structure, thereby creating an extendable modular rail structure.

7. The system of claim 1, the attachment mechanism comprising a plurality of elastic strings secured to the seat and enabling an up-and-down motion of the seat.

8. The system of claim 1, the rail structure having a joint enabling a compressing of the rail structure into a compact shape, the joint to lock when the rail structure is extended.

9. The system of claim 1, the seat to rotate in relation to the rail structure thereby enabling a change in a direction of motion.

10. The system of claim 1, the seat comprising a movable joint configured to open the seat and enable substantially horizontal placement of a person into the seat, wherein the movable joint comprises a hinge.

11. The system of claim 1, the seat comprising a movable joint configured to open the seat and enable substantially horizontal placement of a person into the seat, wherein the seat comprises a locking member to secure the movable joint.

12. The system of claim 1, comprising a transverse member comprising a first end and a second end, the first end detachably secured to the first rail and the second end secured to the second rail, wherein detaching the first end enables substantially horizontal placement of the person into the seat.

13. A method comprising:

providing a rail structure defining an enclosed area, the rail structure attached to a movable upright support resting on the ground, the rail structure comprising a first rail, a second rail and a third rail configured to be secured to the first rail and the second rail and to detach from at least the first rail and enable substantially horizontal placement of a person, wherein detaching the third rail and enabling the substantially horizontal placement of the person maintains a first distance between the first rail and the ground, and a second distance between the second rail and the ground; and providing an attachment mechanism having a distal end and a proximal end, the distal end movably secured to the rail structure, the proximal end secured to a seat and suspending the seat above the ground between the first rail and the second rail, the attachment mechanism to traverse the enclosed area while carrying the seat.

14. The method of claim 13, providing the seat configured to rotate in relation to the rail structure thereby enabling a change in a direction of motion.

15. The method of claim 13, configuring the enclosed area to define a partially curvilinear or a rectilinear shape.

16. The method of claim 13, providing a movable joint associated with the seat and configured to open the seat and enable substantially horizontal placement of the person into the seat.

17. The method of claim 13, comprising:

providing a rail circumventing a closed member of the seat; and providing a wheel traversing the rail to enable rotation of the seat.

* * * * *